US006199497B1

(12) United States Patent
Dhellemmes et al.

(10) Patent No.: US 6,199,497 B1
(45) Date of Patent: Mar. 13, 2001

(54) WATERTIGHT AND THERMALLY INSULATING TANK WITH SIMPLIFIED INSULATING BARRIER BUILT INTO THE BEARING STRUCTURE OF A SHIP

(75) Inventors: Jacques Dhellemmes, Versailles; Pierre Jean, Dampierre, both of (FR)

(73) Assignee: Gaz Transport et Technigaz, Trappes (FR)

( * ) Notice: Subject to any disclaimer, the term of this patent is extended or adjusted under 35 U.S.C. 154(b) by 0 days.

(21) Appl. No.: 09/332,604

(22) Filed: Jun. 14, 1999

(30) Foreign Application Priority Data

Jul. 10, 1998 (FR) ..... 98 08896

(51) Int. Cl.[7] ..... B63B 25/08
(52) U.S. Cl. ..... 114/74 A; 220/901
(58) Field of Search ..... 114/74 R; 220/901

(56) References Cited

U.S. PATENT DOCUMENTS 4,050,608 9/1977 Smith ..... 220/9 LG
5,269,247 * 12/1993 Jean ..... 114/74 A

FOREIGN PATENT DOCUMENTS 0 543 686 A1 5/1993 (EP) .
2 586 082 2/1987 (FR) .
WO 89/09909 10/1989 (WO) .

* cited by examiner

*Primary Examiner*—Jesus D. Sotelo
(74) *Attorney, Agent, or Firm*—Connolly Bove Lodge & Hutz LLP

(57) ABSTRACT

Watertight and thermally insulating tank built into the bearing structure (1) of a ship, the said tank comprising two successive watertightness barriers, one of them a primary one (17) in contact with the product contained in the tank, and the other a secondary one (13) located between the primary watertightness barrier and the bearing structure, a thermally insulating secondary barrier (4) being located between the secondary watertightness barrier and the walls of the bearing structure, characterized in that it comprises an impact-resistant mechanical protecting shield (16) located between the two watertightness barriers, the shield being held elastically pressed against the secondary watertightness barrier by metal fastening means mechanically connected to the secondary insulating barrier, thermal insulation being afforded only by the secondary insulating barrier.

20 Claims, 6 Drawing Sheets

WATERTIGHT AND THERMALLY INSULATING TANK WITH SIMPLIFIED INSULATING BARRIER BUILT INTO THE BEARING STRUCTURE OF A SHIP

The present invention relates to a watertight and thermally insulating tank, particularly for storing a liquefied gas, such as methane, at a temperature of about −160° C., the said tank being built into the bearing structure of a ship.

French Patent 2 629 897 discloses a watertight and thermally insulating tank built into the bearing structure of a ship, the said tank comprising two successive watertightness barriers, one of them a primary one in contact with the product contained in the tank, and the other a secondary one located between the primary barrier and the bearing structure, the said bearing structure comprising, for each tank, on the one hand, walls which are substantially parallel to the axis of the ship and form the internal sides of its double hull and, on the other hand, two transverse bulkheads substantially perpendicular to the axis of the ship, these two watertightness barriers alternating with two thermally insulating barriers, the primary insulating barrier being held pressed against the secondary watertightness barrier by fastening means arranged substantially continuously in a straight line and mechanically joined to the secondary insulating barrier, the corner connection of the primary and secondary barrier elements, in the zones where the transverse bulkheads meet the internal sides of the double hull, being achieved in the form of a connecting ring, the structure of which remains substantially constant along the entire length of the solid angle of intersection between a transverse bulkhead and the internal side of the double hull. Such a tank is generally in the shape of a polyhedron, particularly an irregular octahedron, the tank corners of which generally are at angles of 90° or 135°, which involves the use of a connecting ring which can adapt to suit these different angles.

In French Patent 2 629 897, the connecting ring consists of a number of plates which have varying shapes, for example which are straight, curved or at right angles. All of these plates are welded together to define an interior volume, the cross section of which is square and one side of which corresponds to the thickness of the primary insulating barrier. In the gaps that there are inside the ring and between the ring and the solid angle of intersection at the corner of the tank, blocks of insulating material are inserted in order to ensure the continuity of the primary and secondary insulating barriers. The manufacture of this connecting ring therefore entails numerous operations of welding, forming and assembling, which make manufacture complicated and expensive.

In French Patent 2 724 623, the connecting ring is secured to the bearing structure by welding to anchoring flaps which are perpendicular to the walls. The anchoring flaps are welded to the internal wall of the double hull after the stage of applying protective paint to the double hull. The continuous welding of the anchoring flaps to the internal wall of the double hull generates high flow of heat which runs the risk of damaging the paintwork on the outer side of the internal wall of the double hull and may cause corrosion of the said internal wall of the double hull which wall is intended to be in contact with seawater when the ship is empty and the double hull is being used for ballast. To overcome this drawback, a further coat of paint is applied to those parts of the double hull which have been damaged by the continuous welding of the anchoring flaps, but such reparatory paintwork does not provide as effective a protection against corrosion and entails additional operations which have an adverse effect on the cost of manufacture.

Furthermore, it is known that when the ship is moving on the waves, the deformation of the connecting ring induces very substantial tensile stresses at the primary and secondary watertightness barriers and these stresses in fact combine with the tensile stresses induced in these watertightness barriers when the tank temperature is reduced.

In French Patent 2 709 725, the connecting ring consists in an oblique band which extends from the solid angle of intersection at the corner of the tank as far as the intersection of the primary and secondary watertightness barriers, and this makes it possible to take up the loads induced in the primary and secondary watertightness barriers in close proximity to the solid angle of intersection at a corner of the tank using the oblique band on which the resultant of the loads induced in the tank wall parallel to the double hull and in the tank wall parallel to the transverse bulkhead are exerted. However, such an anchoring band is liable to buckle and has the drawback that it passes through the primary insulating barrier, making a link between the primary watertightness barrier and the secondary watertightness barrier.

The object of the present invention is to provide a tank in which the connecting ring at the corners of the tank has a simple structure and is easy to fit, at a reduced cost. Another object of the invention is to provide a tank in which the improved connecting ring does not damage the paintwork of the double hull. A further object of the invention is to provide a tank in which the improved connecting ring provides continuity of the watertightness of the primary and secondary barriers, and continuity of the thermal insulation, while at the same time having a rigidity comparable with the bearing structure in proximity to the watertightness barriers, so as to improve the resistance of the watertightness barriers to the impacts that occur on the walls of the tank as a result of the movements of the liquid during transport, which movements are due to the rolling and pitching of the ship.

In French Patent 2 629 897 it is proposed that the thermal bridge between the primary watertightness barrier and the bearing structure be eliminated, which makes it possible to reduce the thickness and therefore the weight of the primary insulating barrier, it thus being possible for the said primary insulating barrier to be attached directly to the secondary insulating barrier, because of its lower weight. According to French Patent 2 709 725 it is known that it is advantageous, for the same tank wall thickness, to increase the thickness of the secondary insulating barrier at the expense of that of the primary insulating barrier because if there is a leak at the primary watertightness barrier, the accidental cold zone is further from the double hull, the thicker the secondary barrier. However, the thickness of the primary insulating barrier is the result of a compromise between the thermal insulation function of the primary barrier and the need for this primary insulating barrier to provide good rigidity to impacts caused by the liquid during transport.

Furthermore, as the primary insulating barrier is held pressed against the secondary watertightness barrier by the primary watertightness barrier itself, the said primary and secondary watertightness barriers being secured in watertight fashion to the secondary insulating barrier by fastening means, it is necessary to provide a double expansion joint at the attachment means so as to avoid stresses due to the differential expansion of the primary watertightness barrier and of the secondary watertightness barrier. If a single expansion joint is provided at the fastening means, then the thickness of the fastening means has to be great enough to withstand the shear generated by the absence of expansion joint between the two watertightness barriers.

The second object of the invention is to provide a tank with a simplified insulating barrier, which affords excellent rigidity to the impacts generated by the liquid during transport while at the same time eliminating the problems of differential expansion of the watertightness barriers at the fastening means.

The use of a secondary insulating barrier consisting of a thermally insulating layer of cellular plastic such as a polyurethane foam reinforced with fiberglass fabric inserted into the said foam to give it good mechanical properties, is known from French Patent 2 724 623.

Also known from French Patent 2 683 786 is a secondary insulating barrier consisting of a number of caissons each of which comprises a parallelepipedal box made of plywood equipped internally with longitudinal and transverse partitions and filled with particulate lagging known, for example, by the name of "perlite".

However, these insulating barriers have a complicated structure and their cost of manufacture is high.

The third object of the invention is to provide a tank with an improved insulating barrier, which has good mechanical properties while at the same time being simple and economical to manufacture.

To achieve the first aforementioned objective, the first subject of the invention is a watertight and thermally insulating tank built into the bearing structure of a ship, the said tank comprising two successive watertightness barriers, one being a primary one in contact with the product contained in the tank, and the other being a secondary one located between the primary barrier and the bearing structure, the said bearing structure comprising, for each tank, on the one hand, walls which are substantially parallel to the axis of the ship and form the internal sides of its double hull and, on the other hand, two transverse bulkheads substantially perpendicular to the axis of the ship, these two watertightness barriers alternating with two thermally insulating barriers, the primary insulating barrier being held pressed against the secondary watertightness barrier by fastening means arranged substantially continuously in a straight line and mechanically joined to the secondary insulating barrier, the corner connection of the primary and secondary barriers, in the zones where the transverse bulkheads meet the internal sides of the double hull, being achieved in the form of a connecting ring, the structure of which remains substantially constant along the entire length of the solid angle of intersection between a transverse bulkhead and the internal sides of the double hull, characterized in that each connecting ring comprises a prefabricated composite girder made up of rigid metal formwork, especially made of stainless steel, incorporated in a thermally insulating material, especially a polyurethane foam, the said rigid formwork defining a central fixed anchorage zone substantially at the intersection between the plane bisecting the connection corner starting from the solid angle of intersection and the extension of the secondary watertightness barrier, on each side of the said solid angle of intersection, for mechanically securing the secondary watertightness barrier to the said central fixed anchorage zone of the formwork, the opposite ends of the said formwork being secured to the bearing structure by fixing means borne respectively by a transverse bulkhead and by an internal side of the double hull.

As a preference, the prefabricated composite girder is made up of a number of single-piece sections obtained by injection-molding or bonding of polyurethane or any other insulating material in a mold in which the formwork is prepositioned, so as to form a foam.

Advantageously, the formwork of the composite girder is formed of a metal strip extending in the transverse direction and with a W-shaped overall profile, the two end branches of which are substantially parallel to the respective bearing walls on each side of the solid angle of intersection, the said end branches being secured to the aforementioned fixing means, and the two central branches of which at their vertex define the aforementioned central fixed anchorage zone, the distance between the said vertex and each bearing wall corresponding to the thickness of the secondary insulating barrier.

According to another feature, the fixing means consist of a peripheral row of threaded studs welded at their base at right angles to each bearing wall on each side of the solid angle of intersection. The local welding of the studs to the bearing walls generates a heat flux which is low enough that it does not risk damaging the paintwork on the double hull.

In a preferred embodiment, the composite girder comprises, on its opposite surface to the internal side of the double hull, a number of wells which are evenly spaced in the transverse direction and extend at right angles to the transverse bulkhead, and on its opposite surface to the transverse bulkhead, a number of wells which are evenly spaced in the transverse direction and extend at right angles to the internal side of the double hull, the wells being formed by cavities in the insulating material of the composite girder, which cavities open toward the respective bearing wall onto an end branch of the W-shaped formwork strip, the said end branch defining the bottom of each well which has a hole for the passage of a threaded stud of the aforementioned fixing means which are designed to be in register with the said wells, the formwork being held firmly on the said studs by a nut which is screwed onto the stud and bears against the bottom of each well.

According to another feature, the said W-shaped formwork comprises reinforcing webs extending respectively between the adjacent branches of the W, the webs being located in parallel planes which are evenly spaced in the transverse direction and perpendicular to the walls of the bearing structure. As a preference, the reinforcing webs are inserted substantially mid-way between two successive cavities in the transverse direction.

Advantageously, the formwork comprises an anchor bracket, particularly one made of stainless steel, substantially a right-angle bracket, welded at its center to the said central fixed anchorage zone so that the arms of the bracket extend substantially in the direction of the secondary watertightness barrier on each side of the solid angle of intersection, the said secondary watertightness barrier partially overlapping the said arms so that they can be secured mechanically, by discontinuous welding, allowing transverse expansion between the secondary watertightness barrier and the said anchor bracket.

In-a particular embodiment, the passage holes for the studs are substantially U-shaped and the wells comprise, near their bottom, a 45° undercut toward the base of the U so as to allow the composite girder to be inserted into a 90° tank corner along the bisector of the angle without being impeded by the row of studs.

According to yet another feature, the secondary watertightness barrier is made up of metal strakes with edges turned up toward the inside of the tank, the said strakes being made from thin plate with a low coefficient of expansion and being butt-welded, via their turned-up edges, onto the two faces of a weld support which is held mechanically on the elements of the secondary insulating barrier by an expansion joint, the said weld support constituting part of the fastening means intended to mechanically hold the primary insulating barrier on the secondary watertightness barrier. The secondary watertightness barrier is connected to the composite girder by secondary watertight liner plates with edges turned up toward the inside of the tank, the said liner plates being made of thin plate with a low coefficient of expansion and being butt-welded via their turned-up edges onto the two faces of a weld support, the said turned-up edges tapering gradually, for example substantially in the manner of a whistle, in the vicinity of the composite girder so as to form, on the proximal portion of the said liner plate, a straight edge in line with one of the turned-up edges and on the opposite lateral edge an overlapping lug which is bent slightly downward, and is intended to be overlapped by the straight edge of the next liner plate, substantially in the manner of a set of tiles, the proximal parts of the liner plates being welded together in watertight manner at the zone of overlap of each overlapping lug, the said liner plates being secured mechanically to the anchor bracket by the said discontinuous weld.

In this case, there is provided a secondary watertightness bracket made of thin plate with a low coefficient of expansion and substantially at a right angle, the arms of which partially cover the proximal portion of the secondary watertight liner plates and are continuously welded to the latter in the transverse direction so as to ensure the continuity of the watertight connection of the secondary watertightness barrier.

According to yet another feature the overlapping lugs of the liner plates extend partially along one arm of the anchor bracket and partially along a sheet of plywood which forms a bridge between the composite girder and the adjacent element of the secondary insulating barrier, and acts as a cover plate to fill the space between the composite girder and the said adjacent element of the secondary insulating barrier, the said sheet of plywood having square-sided cut-outs and the said anchor bracket having machining designed to accommodate each overlapping lug of the liner plates.

According to yet another feature, the primary watertightness barrier is made up of metal strakes with edges turned up toward the inside of the tank, the said strakes being made from thin plate with a low coefficient of expansion and being butt-welded, via their turned-up edges, onto the two faces of the said weld support which is held mechanically by the secondary insulating barrier. The said primary watertightness barrier is connected to the composite girder by primary watertightness liner plates with edges turned up toward the inside of the tank, the said primary watertightness liner plates consisting of thin plate with a low coefficient of expansion and being butt-welded, via their turned-up edges, onto the two faces of the said weld support, the said turned-up edges of the primary liner plate tapering gradually, for example substantially in the manner of whistles, in the vicinity of the composite girder so as to form on the proximal portion of the primary liner plate a straight edge in line with one of the turned-up edges and on the opposite lateral edge an overlapping lug bent slightly downward which is intended to be overlapped by the straight edge of the next primary liner plate, in the manner of a set of tiles, the said overlapping lugs of the primary liner plates being welded to the adjacent primary liner plates at the said zone of overlap, the said overlapping lugs of the primary liner plates extending partially over the proximal portion of the primary liner plates starting from the turned-up edge, so that the end part of the said proximal portion is bent downward substantially in the manner of the steps of a staircase, the height of which corresponds to the thickness of the primary insulating barrier, the said end part being welded discontinuously to the proximal portion of the underlying secondary liner plate to secure them together mechanically.

In this case, there is provided a primary watertightness bracket made of thin plate with a low coefficient of expansion and substantially in the shape of a right angle bracket, the arms of which partially overlap the proximal portion of the primary liner plates in the plane of the primary watertightness barrier, the arms of the primary watertightness bracket being welded continuously to the said primary liner plates to ensure the continuity of the watertight connection of the primary watertightness barrier.

Advantageously, the arms of the primary watertightness bracket overlap a row of screws which pass through the proximal portion of the primary liner plate to anchor it to the primary insulating barrier.

In an alternative embodiment, the primary insulating barrier is replaced by an impact-resistant mechanical protecting shield, thermal insulation being provided only by the secondary insulating barrier. For example, the shield consists of a number of substantially parallelepipedal rigid plywood panels of small thickness, for example of the order of 21 mm thick, between which the aforementioned fastening means pass.

The fact of providing a shield which is not thermally insulating in place of the primary insulating barrier makes it possible to avoid all problems of differential expansion of the primary and secondary watertightness barriers and therefore to eliminate the use of a double expansion joint and all problems of shear when using a single expansion joint, because the two watertightness barriers will experience the same thermal expansion. Thus, the shield is kept pressed against the secondary watertightness barrier by the primary watertightness barrier itself, the said watertightness barriers being secured in watertight fashion to the same weld support.

According to another feature, the secondary insulating barrier comprises a number of substantially parallelepipedal elements each consisting of a layer of insulating material sandwiched between two sheets of plywood which respectively form the bottom and the cover of one element of the secondary insulating barrier, the said sheets being bonded on their inside face to the layer of insulating material and being intended via their outside surface, to make the connection with the bearing structure and with the secondary watertightness barrier, respectively.

According to yet another feature, the weld support comprises a row of lugs partially cut out from its thickness and alternately bent to one side of its plane and then to the other, to be housed in recesses made in the upper surface of the shield elements, to temporarily hold the shield on the secondary watertightness barrier before the primary watertightness barrier is fitted.

In a way known per se, the fastening means are L-profile strips each having a short side and a long side at right angles, the long side forming the weld support and the short side being inserted in an inverted T-shaped slot made in the thickness of the cover-forming sheet of the elements of the secondary insulating barrier which supports the secondary watertightness barrier, the free end of the weld support projecting toward the inside of the tank with respect to the primary watertightness barrier.

In a particular embodiment, the layer of insulating material is a polyurethane foam with a density of between 90 and 120 kg/$^3$, preferably of the order of 100 kg/$^3$, to guarantee mechanical support of the watertightness barriers subjected to the pressure and movements of the cargo.

According to yet another feature, the shield comprises plywood blocks inserted on each side of the solid angle of intersection between the primary and secondary watertightness brackets and the staircase-shaped end portions of the primary watertightness liner plates.

In another alternative embodiment, the layer of insulating material of the secondary insulating barrier consists of a block with a cellular honeycomb structure giving high mechanical strength.

Advantageously, the block with honeycomb structure comprises radiation-reflecting elements covering at least part of the flat internal faces of the cells of the honeycomb structure, it being possible for these radiation-reflecting elements to consist of silver leaf or polished aluminum.

From French Patent 2 586 082 it is known that when radiation-reflecting elements are installed in the volume of the secondary insulating barrier, the thermal losses by radiation can be reduced, which is something which improves the insulation provided by the secondary barrier.

As a preference, at least some of the walls of the cells of the honeycomb block are perforated so as to allow fluid communication between the said cells and the outside of the block, and the volume occupied by the secondary insulating barrier is subject to a reduced pressure of between 0.1 and 300 millibar absolute, preferably between 2 and 3 millibar. Establishing a reduced pressure in the volume occupied by the secondary insulating barrier makes it possible to considerably reduce the thermal losses by convection. Combining a reduced pressure with radiation-reflecting elements makes it possible to achieve an optimal reduction in thermal losses.

According to another feature, the gas at reduced pressure which occupies the volume of the secondary insulating barrier is an inert gas giving satisfactory insulating properties.

According to yet another feature, the volume occupied by the secondary insulating barrier is permanently connected to a variable vacuum pump for adjusting the pressure in this volume to suit the desired vaporization of the liquefied gas stored in the tank to act as a fuel for propelling the ship.

As a preference, the vacuum pump is self regulating, so that it restarts as soon as the pressure in the aforementioned volume rises to a predetermined pressure threshold, for example of the order of 7 millibar, and stops as soon as another, predetermined, lower, pressure threshold is reached, for example of the order of 2 to 3 millibar.

Advantageously, the block with a cellular honeycomb structure is obtained from a folded cardboard blank.

In one particular embodiment, the tank comprises means of fixing the secondary insulating barrier to the bearing structure, these fixing means comprising studs welded substantially at right angles to the internal walls of the bearing structure, the said studs each having a threaded free end, the relative arrangement of the studs and of the elements of the secondary insulating barrier being contrived to be such that the studs are in register with two opposed peripheral edges of the bottom sheet of the elements of the secondary insulating barrier, a well being formed through the cover-forming sheet of the said element and through the thickness of the honeycomb block in register with each stud, the bottom of the well consisting of the bottom sheet which has a hole for the passage of a stud, a washer placed over the stud pressing against the bottom of the well and being held in place by a nut screwed onto the stud so as to fix the said element of the secondary insulating barrier to the bearing structure. As a preference, each well is filled in, after the element of the secondary insulating barrier has been fixed to the bearing structure, with a thermally insulating plug, any joins between the elements of the secondary insulating barrier also being filled in with a thermally insulating material.

The sheet which forms the cover preferably comprises two parallel slots each accommodating a weld support and which are spaced apart by a distance that corresponds to the width of a strake, the central zones of the sheets forming covers of two adjacent elements each being covered by a strake, while another strake of the same width joins the aforementioned two strakes together.

To achieve the second aforementioned objective, the second subject of the invention is a watertight and thermally insulating tank built into the bearing structure of a ship, the said tank comprising two successive watertightness barriers, one of them a primary one in contact with the product contained in the tank, and the other a secondary one located between the primary watertightness barrier and the bearing structure, a thermally insulating secondary barrier being located between the secondary watertightness barrier and the walls of the bearing structure, characterized in that it comprises an impact-resistant mechanical protecting shield located between the two watertightness barriers, the shield being held elastically pressed against the secondary watertightness barrier by metal fastening means mechanically connected to the secondary insulating barrier, thermal insulation being afforded only by the secondary insulating barrier.

Advantageously, the secondary watertightness barrier is made up of metal strakes with edges turned up toward the inside of the tank, the said strakes being made from thin plate with a low coefficient of expansion and being butt-welded, via their turned-up edges, onto the two faces of a weld support which is held mechanically on the elements of the secondary insulating barrier by an expansion joint, the said weld support constituting part of the fastening means intended to mechanically hold the shield on the secondary watertightness barrier.

Advantageously, the shield consists of a number of substantially parallelepipedal rigid plywood panels of small thickness, for example of the order of 21 mm thick, between which the aforementioned fastening means pass.

As a preference, the fastening means are L-profile strips each having a short side and a long side forming a right angle bracket, the long side forming the weld support and the short side being inserted in an inverted T-shaped slot made in the thickness of a cover-forming rigid sheet of the elements of the secondary insulating barrier and supporting the secondary watertightness barrier, the free end of the weld support projecting toward the inside of the tank with respect to the primary watertightness barrier.

According to another feature, the secondary insulating barrier comprises a number of substantially parallelepipedal elements each consisting of a layer of insulating material sandwiched between two sheets of plywood which respectively form the bottom and the cover of one element of the secondary insulating barrier, the said sheets being bonded on their inside face to the said layer and serving as a connection, via their outside surface, with the bearing structure and with the secondary watertightness barrier, respectively.

In a way known per se, the primary watertightness barrier is made up of metal strakes with edges turned up toward the inside of the tank, the said strakes being made from thin plate with a low coefficient of expansion and being butt-welded, via their turned-up edges, onto the two faces of the said weld support which is held directly by the secondary insulating barrier.

Advantageously, the weld support comprises a transverse row of lugs partially cut out from its thickness and bent over alternately to one side of its plane and then to the other into housings made in the upper part of the periphery of the panels of the shield to temporarily hold the shield on the secondary watertightness barrier before the primary watertightness barrier is fitted.

Advantageously, the shield is held pressed against the secondary watertightness barrier by the primary watertightness barrier, the said primary and secondary watertightness barriers being secured in watertight fashion to the said fastening means.

According to another feature, the layer of insulating material is a polyurethane foam with a density of between 90 and 120 kg/m$^3$, preferably of the order of 100 kg/m$^3$.

In another alternative form, the layer of insulating material is a block with a cellular honeycomb structure giving high mechanical strength.

Advantageously, the block with honeycomb structure comprises radiation-reflecting elements covering at least part of the flat internal faces of the cells of the honeycomb structure, it being possible for these radiation-reflecting elements to consist of silver leaf or polished aluminum.

As a preference, at least some of the walls of the cells of the honeycomb block are perforated so as to allow fluid communication between the said cells and the outside of the block, and the volume occupied by the secondary insulating barrier is subject to a reduced pressure of between 0.1 and 300 millibar absolute, preferably between 2 and 3 millibar.

Advantageously, the block with a cellular honeycomb structure is obtained from a folded cardboard blank.

In a particular embodiment, the tank comprises means of fixing the secondary insulating barrier to the bearing structure, these fixing means comprising studs welded substantially at right angles to the internal walls of the bearing structure, the said studs each having a threaded free end, the relative arrangement of the studs and of the elements of the secondary insulating barrier being contrived to be such that the studs are in register with two opposed peripheral edges of the bottom sheet of the elements of the secondary insulating barrier, a well being formed through the cover-forming sheet of the said element and through the thickness of the honeycomb block in register with each stud, the bottom of the well consisting of the bottom sheet which has a hole for the passage of a stud, a washer placed over the stud pressing against the bottom of the well and being held in place by a nut screwed onto the stud so as to fix the said element of the secondary insulating barrier to the bearing structure.

The sheet which forms the cover preferably comprises two parallel slots each accommodating a weld support and which are spaced apart by a distance that corresponds to the width of a strake, the central zones of the sheets forming covers of two adjacent elements each being covered by a strake, while another strake of the same width joins the aforementioned two strakes together.

In order to achieve the third aforementioned objective, the third subject of the invention is a watertight and thermally insulating tank built into the bearing structure of a ship, the said tank comprising two successive watertightness barriers, one being a primary one in contact with the product contained in the tank, and the other being a secondary one located between the primary watertightness barrier and the bearing structure, the two watertightness barriers alternating with two thermally insulating barriers, the primary insulating barrier being held pressed elastically against the secondary watertightness barrier by metal fastening means mechanically joined to the secondary insulating barrier, characterized in that the secondary insulating barrier comprises a number of substantially parallelepipedal elements each consisting of a block with a honeycomb cellular structure providing high mechanical strength, each block being sandwiched between two sheets of plywood which respectively form the bottom and the cover of one element of the secondary insulating barrier, the said sheets being bonded by their internal surface to the central block and serving, via their external surface, for providing the connection with the bearing structure and with the secondary watertightness barrier, respectively.

Advantageously, the secondary watertightness barrier is made up of metal strakes with edges turned up toward the inside of the tank, the said strakes being made from thin plate with a low coefficient of expansion and being butt-welded, via their turned-up edges, onto the two faces of a weld support which is held mechanically on the elements of the secondary insulating barrier by an expansion joint, the said weld support constituting part of the fastening means intended to mechanically hold the primary insulating barrier on the secondary watertightness barrier.

Advantageously, the block with honeycomb structure comprises radiation-reflecting elements covering at least part of the flat internal faces of the cells of the honeycomb structure, it being possible for these radiation-reflecting elements to consist of silver leaf or polished aluminum.

As a preference, at least some of the walls of the cells of the honeycomb block are perforated so as to allow fluid communication between the said cells and the outside of the block, and the volume occupied by the secondary insulating barrier is subject to a reduced pressure of between 0.1 and 300 millibar absolute, preferably between 2 and 3 millibar.

According to another feature, the gas at reduced pressure which occupies the volume of the secondary insulating barrier is an inert gas giving satisfactory insulating properties.

According to yet another feature, the volume occupied by the secondary insulating barrier is permanently connected to a variable vacuum pump for adjusting the pressure in this volume to suit the desired vaporization of the liquefied gas stored in the tank to act as a fuel for propelling the ship.

As a preference, the vacuum pump is self regulating, so that it restarts as soon as the pressure in the aforementioned volume rises to a predetermined pressure threshold, for example of the order of 7 millibar, and stops as soon as another, predetermined, lower, pressure threshold is reached, for example of the order of 2 to 3 millibar.

Advantageously, the block with a cellular honeycomb structure is obtained from a folded cardboard blank.

In one particular embodiment, the tank comprises means of fixing the secondary insulating barrier to the bearing structure, these fixing means comprising studs welded substantially at right angles to the internal walls of the bearing structure, the said studs each having a threaded free end, the relative arrangement of the studs and of the elements of the secondary insulating barrier being contrived to be such that the studs are in register with two opposed peripheral edges of the bottom sheet of the elements of the secondary insulating barrier, a well being formed through the cover-forming sheet of the said element and through the thickness of the honeycomb block in register with each stud, the bottom of the well consisting of the bottom sheet which has a hole for the passage of a stud, a washer placed over the stud pressing against the bottom of the well and being held in place by a nut screwed onto the stud so as to fix the said element of the secondary insulating barrier to the bearing structure. As a preference, each well is filled in, after the element of the secondary insulating barrier has been fixed to the bearing structure, with a thermally insulating plug, any joins between the elements of the secondary insulating barrier also being filled in with a thermally insulating material.

The sheet which forms the cover preferably comprises two parallel slots each accommodating a weld support and which are spaced apart by a distance that corresponds to the width of a strake, the central zones of the sheets forming covers of two adjacent elements each being covered by a strake, while another strake of the same width joins the aforementioned two strakes together.

In an alternative, the primary insulating barrier is replaced by an impact-resistant mechanical protecting shield, thermal insulation being provided only by the secondary insulating barrier.

For a better understanding of the various objects of the invention, several embodiments which are depicted in the appended drawing will now be described by way of purely illustrative and nonlimiting examples.

Figure 1:
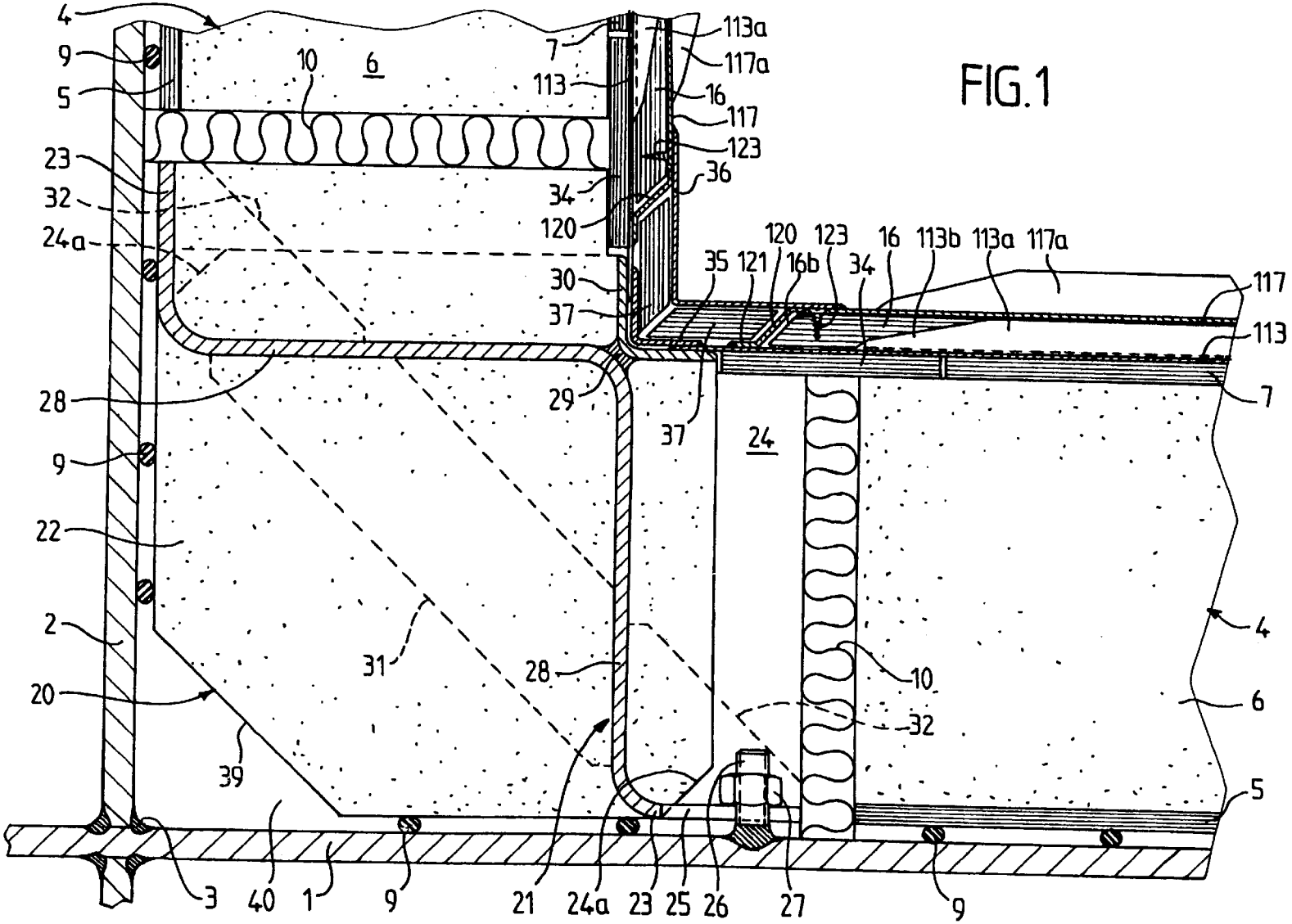
FIG. 1 is a partial view of a corner of a tank in accordance with the first subject of the invention, in section on a plane perpendicular to the solid angle of intersection of the dihedron formed by the said corner.

Referring to FIG. 1, there can be seen the corner of a tank of the invention, the said tank being built into a bearing structure, one wall of which is formed by the internal side 1 of the double hull of a ship and another wall of which is formed by a transverse bulkhead 2 of a double bulkhead which acts as a divider between two tanks. The bearing walls 1 and 2 form an angle of 900 between them and define a solid angle 3 of intersection. The transverse bulkheads are attached to the double hull by welding.

Figure 4:
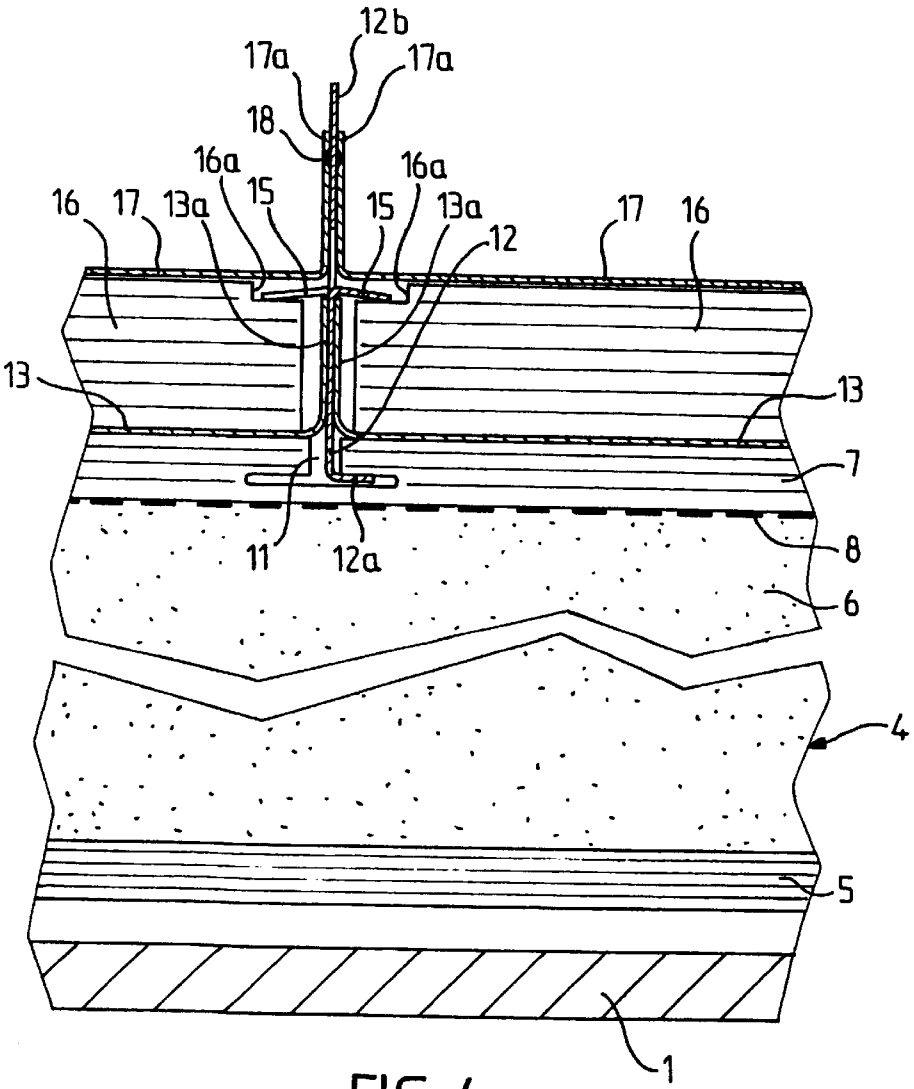
FIG. 4 is a partial view in section on a transverse plane perpendicular to the double hull of the ship, more specifically illustrating the second subject of the invention.
Figure 7:
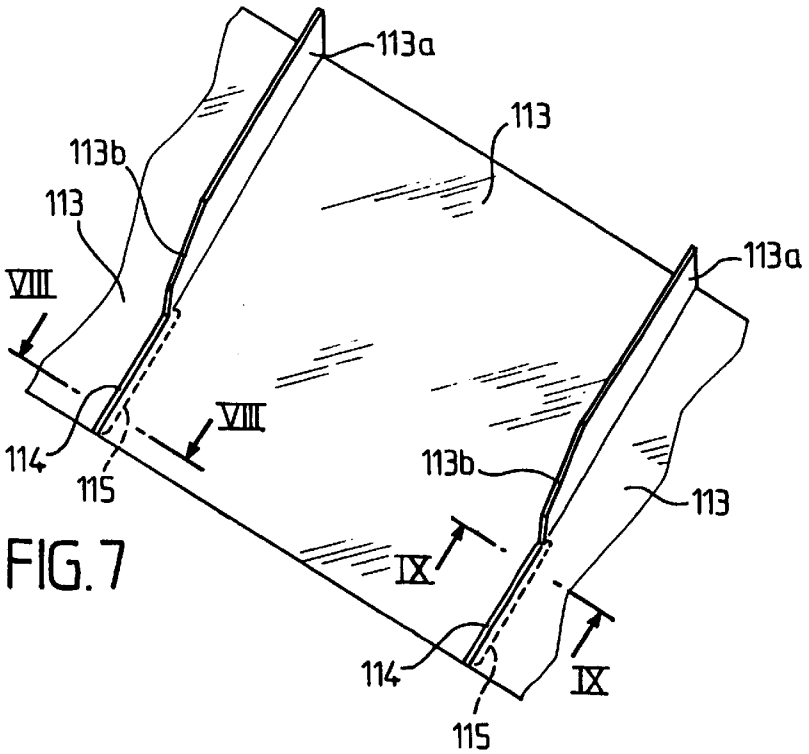
FIG. 7 is a partial and perspective view of the secondary watertightness liner plates of FIG. 6, in their assembled state.

The tank according to the invention comprises a secondary insulating barrier fixed to the bearing structure of the ship. The secondary insulating barrier consists of a number of right-angled parallelepipedal elements 4 which are arranged side by side so that they substantially cover the internal surface of the bearing structure. Each element 4 consists of a first sheet 5 of plywood forming the bottom of the element 4, the bottom sheet 5 being surmounted by a thick layer of thermal insulation 6 which is bonded to the inside surface of the sheet 5. Bonded to the layer of thermal insulation 6 is a second sheet 7 of plywood which forms the cover of the element 4. As can be seen in FIG. 4, a fiberglass fabric 8 may be inserted at the interface between the sheet 6 and the sheet 7 which forms the cover. This fabric 8 may be added in order to give the layer of thermal insulation 6 good mechanical properties. The layer 6 may consist of a cellular plastic such as a polyurethane foam. Of course, it would be possible to provide several fiberglass fabrics within the thickness of the layer 6, as described in greater detail in French Patent 2 724 623 which is incorporated herein by reference. Although this is not depicted in the figures, it is known practise, for securing the elements 4 to the bearing structure, to provide wells which are evenly distributed along the periphery of the element 4, the wells being cylindrical recesses made through the sheet 7 forming the cover and the thickness of the layer 6 as far as the bottom sheet 5. The bottom of a well thus consists of the rigid bottom sheet 5 of the element 4. The bottom of the well is perforated to form a hole, the diameter of which is large enough to allow a stud to pass through. These studs are welded to the inside face of the bearing structure at right angles thereto and have a threaded free end. These studs are arranged in lines parallel to the solid angle 3 of intersection formed at the intersection between the aforementioned bearing walls 1 and 2. Of course, the studs and the wells are arranged in such a way that if an element 4 is offered up opposite the bearing wall, the said element 4 can be positioned with respect to the said wall in such a way that there is a stud facing each well.

It is known that the walls 1 and 2 of a ship differ from the theoretical surface intended for the bearing structure, simply as a result of manufacturing imprecisions. As is known, these differences are compensated for by bringing the bottom sheets 5 up against the bearing structure using wads of polymerizable resin 9 (see FIG. 1) which make it possible, starting from an imperfect bearing structure surface, to obtain cladding consisting of adjacent elements 4 which exhibit sheets 7 forming a cover and which, together, define a surface which practically does not deviate from the desired theoretical surface. The wads of resin 9 are arranged parallel to the aforementioned solid angle 3 of intersection and spaced apart. Each element 4 is pressed in the direction of the bearing structure until blocks (not depicted) of predetermined dimensions fixed, for example, to the four corners of the bottom sheet 5 come up against the said bearing structure. In this position, the wads of polymerizable resin 9 are crushed to greater or lesser extents and this technique makes it possible to compensate for any defects exhibited by the bearing wall in the static state compared with the theoretical surface. The size of the blocks is calculated from a precise record of the position in space of the internal face of the bearing wall.

When an element has been correctly positioned in this way, the element 4 is secured using the studs which enter the wells in the element 4 through the aforementioned holes, securing being obtained by placing over the threaded ends of the studs a thrust washer and a tightening nut (neither depicted). This washer is pressed by the nut against the bottom of the well so that each element 4 is secured against the bearing structure by a number of points spread around the periphery of the bottom sheet 5, which is advantageous from the mechanical viewpoint.

Next, the polymerizable wads 9 cure in a few hours by polymerization, which makes it possible to remove the blocks later. However, before pressing the elements 4 against the bearing structure, a film of polyane or any other material (not depicted) may be inserted between this structure and the wads 9 to prevent the resin of the wad from sticking to the bearing wall and thus allow dynamic deformation of the bearing wall without the element 4 experiencing the loadings that are due to the said deformation between the means of securing the elements 4 to the bearing structure.

Once securing is complete, the wells are plugged by inserting plugs (not depicted) of thermally insulating material, these plugs lying flush at the level of the sheet 7 forming the cover of the element 4.

Furthermore, a thermally insulating material, for example a flexible insulation 10, is fitted into the joint zones between two elements 4. The overall structure of the wells for securing to the studs may be of the type described in French Patent 2 724 623.

As an alternative, the secondary insulating barrier could consist of a number of caissons as described in European Patent 543 686 which is incorporated herein by reference. These caissons consist overall of a parallelepipedal box made of plywood, inside which longitudinal partitions and transverse partitions have been placed, the inside of the caisson being filled with a particulate lagging such as the one known by the name of "perlite". These caissons are secured to the bearing structure by metal lugs bent over at right angles at the periphery of the base of the caisson.

Formed in the upper face of the sheet 7 forming the cover of an element 4 is at least one slot 11 extending in the longitudinal direction of the ship, that is to say at right angles to the wads 9. The slots 11 have a cross section which is in the overall shape of an inverted T, the bar of which T runs completely within the thickness of the sheet 7 and the upright of the T emerges on the outside face of the sheet 7 toward the inside of the tank. Fitted into each slot 11 is a fastening means which allows, on the one hand, a secondary watertightness barrier and, on the other hand, a primary watertightness barrier, both of which will be described later, to be held on the secondary insulating barrier. The fastening means consists of a weld flange 12 bent into an L shape, the short branch 12*a* of the L being inserted by sliding into one of the two branches of the bar of the T of the slot 11, while the long branch 12*b* of the L passes through the upright of the T of the slot 11 and extends beyond the primary watertightness barrier inside the tank. The weld flange 12 consists of a sheet of Invar which defines an expansion joint where it meets the sheet 7. The long branch 12*b* of the L of the weld flange 12 defines a weld support for connecting to the primary and secondary watertightness barriers, as explained below.

The secondary watertightness barrier is formed of strakes 13 made of Invar sheet 0.7 mm thick, with turned-up edges 13*a*. These Invar strakes 13 form strips approximately 50 cm wide between two turned-up edges which are welded by their turned-up edges 13*a* on each side of the weld support 12*b*, as illustrated in FIG. 4. The turned-up edges 13*a* and the weld support project above the surface formed by the strakes 13. As the welds along the turned-up edges 13*a* are watertight, this then forms a secondary watertightness barrier pressed against the secondary insulating barrier.

Figure 5:
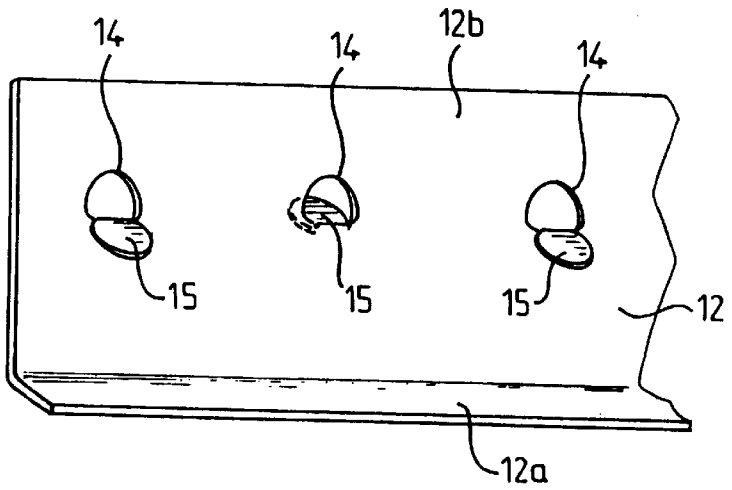
FIG. 5 is a partial, enlarged and perspective view of the weld support illustrated in FIG. 4.

As can be seen in FIG. 5, the weld support 12*b* comprises, substantially mid-way along its height, a number of puncture holes 14 which define fastening lugs 15 which have been cut out partially from the thickness of the weld flange and bent over substantially at right angles to the plane of the weld support 12*b*. As a preference, the fastening lugs 15 are bent alternately to one side of the plane of the weld support and then to the other, and are substantially in line with one another so that they extend above the upper edge of the turned-up edges 13*a* of the strakes 13, as visible in FIG. 4.

When the secondary watertightness barrier has been formed, plywood panels 16 approximately 21 mm thick are placed between the weld supports 12*b*. These panels 16 come up against the strakes 13 of the secondary watertightness barrier and on their upper surface comprise two housings 16*a* extending along the edges facing the weld supports 12*b*, which allows the fastening lugs 15 to be bent over into these housings 16 [sic], which prevents the panels 16 from becoming detached from the secondary watertightness barrier supporting them and makes it possible, for holding them definitively in place, to wait for the primary watertightness barrier to be fitted. The panels 16 constitute an impact-resistant mechanical protection shield, this shield replacing the primary insulating barrier generally provided, thermal insulation here being afforded only by the secondary insulating barrier.

The primary watertightness barrier consists of strakes 17 made of Invar sheet with turned-up edges 17*a* and about 0.5 mm thick. The width of the strakes 17 is about 50 mm, so that the turned-up edges 17*a* come on each side of the weld support 12*b*; it is therefore possible, in a known way, using an automatic machine, to produce a continuous watertight weld between the edges 17*a* and the weld support 12*b*, as was previously done in the case of the edges 13*a* and the weld support 12*b*. The continuous weld between the turned-up edges 17*a* and the weld support 12*b* has been indicated by 18 in FIG. 4.

As visible in FIG. 4, the upper edge of the weld support 12*b* extends beyond the turned-up edges 17*a* toward the inside of the tank and the fastening lugs 15 extend under the strakes 17.

The production of the connecting ring which will be installed between the tank wall 1 which runs along the double hull of the ship and the tank wall 2 which runs along a transverse bulkhead of the ship will now be described. The connecting ring consists of a prefabricated composite girder 20 which comprises rigid metal formwork 21, for example made of stainless steel, embedded in a thermally insulating material 22, for example polyurethane foam. This girder 20 is in the shape of a prism and is symmetrical with respect to a plane bisecting the corner starting at the solid angle 3 of intersection and formed between the bearing walls 1 and 2 of the ship. The bases of the prism 20 are perpendicular to the walls 1 and 2. The girder 20 has a structure which remains substantially constant along the entire length of the solid angle 3 of intersection at the corner of the tank. The formwork 21 is a bent metal strip with a substantially W-shaped profile, the two end branches 23 of which are parallel to the respective bearing walls on each side of the solid angle 3 of intersection. These end branches 23 of the W are not covered with thermally insulating material on their outer face which lies flush with the outer surface of the rest of the girder.

Figure 2:
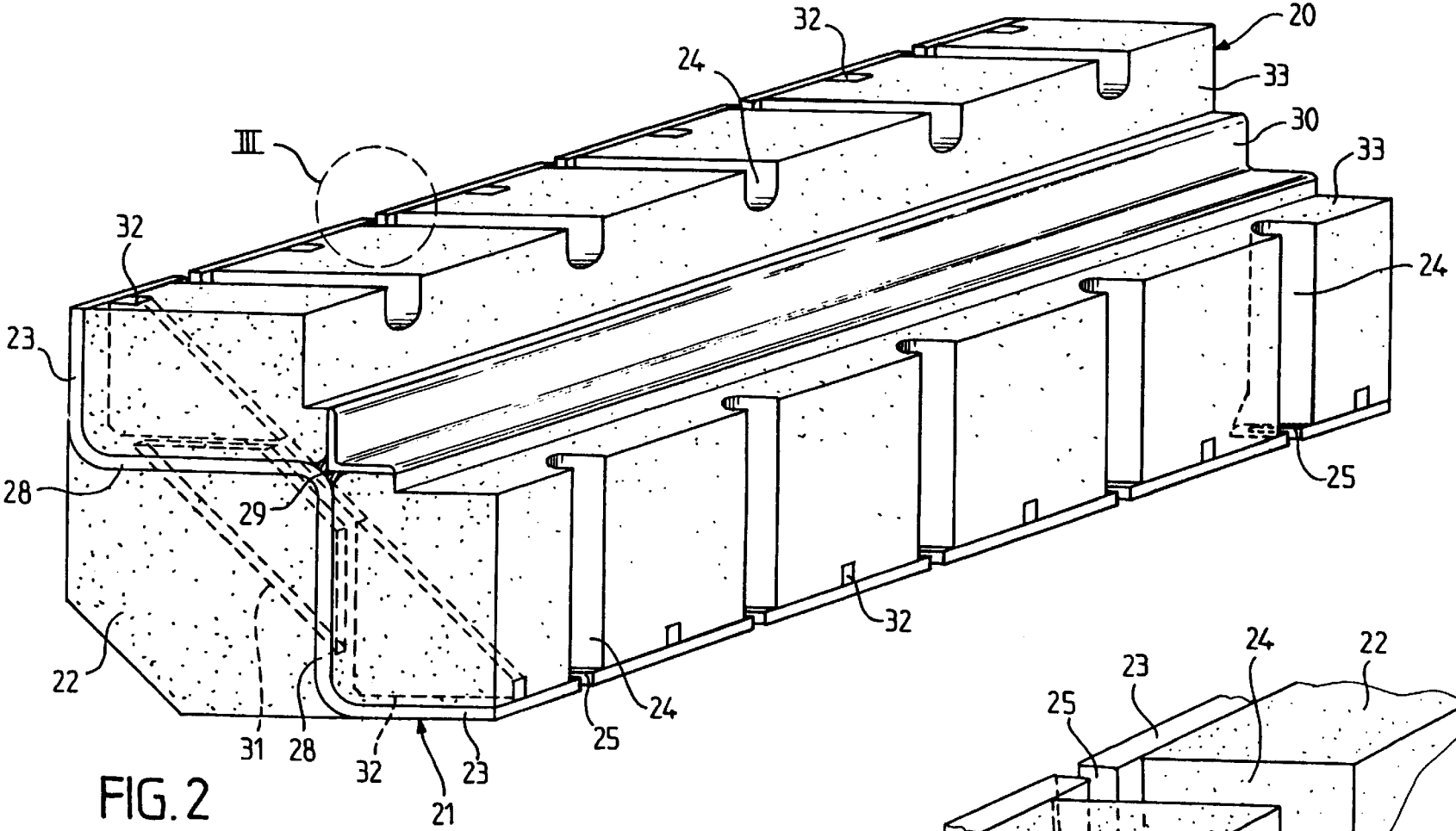
FIG. 2 is a view in perspective of the prefabricated composite girder illustrated in FIG. 1 and used for making a connection at a corner of a tank.
Figure 3:
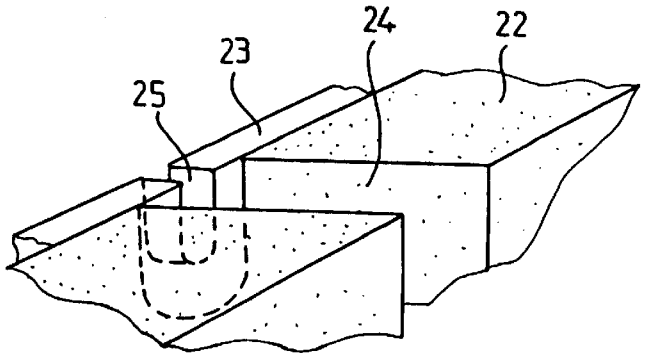
FIG. 3 is an enlarged view of a ringed detail labeled III in FIG. 2.

Formed at right angles to each end branch 23 are wells 24 which extend through the thickness of the insulating material 22 of the girder 20. The wells 24 are evenly spaced apart along the solid angle 3 of intersection, as can be seen in FIG. 2. The wells 24 are open on the outside face of the girder 20 which faces the adjacent element 4 of the secondary insulating barrier. The wells 24 have a substantially U-shaped cross section. The bottom of the wells 24 is formed by the end branch 23 of the formwork 21, a U-shaped hole 25 being formed in the said end branch 23 in line with each well 24, for the passage of a threaded stud 26. The studs 26 are welded at their base at right angles to each bearing wall, on each side of the solid angle 3 of intersection, in a transverse direction of the ship, in the manner of the threaded studs used for securing the secondary insulating barrier. A nut 27 is screwed onto the threaded free end of the stud 26 and presses against the bottom of the well 24 to secure the formwork 21 and therefore the girder 20 to the bearing structure. As best visible in FIG. 1, each weld 24 comprises, near its bottom, a substantially 45° undercut 24*a*, to allow the composite girder 20 to be inserted in a corner of the tank without being impeded by the rows of studs 26.

Wads 9 of polymerizable resin may be inserted between the walls of the bearing structure and the surfaces facing it of the composite girder 20, as is already the case with the secondary insulating barrier.

The two central branches 28 of the W-shaped formwork define, at their common vertex 29, an anchorage zone the rigidity of which is comparable with that of the bearing structure of the ship. An anchor bracket 30, for example made of stainless steel, is welded to this vertex 29 and has the shape of a right angle bracket, the two arms of which extend substantially in the direction of the secondary watertightness barrier, on each side of the solid angle 3 of intersection. This anchor bracket 30 is intended to provide mechanical attachment to the secondary watertightness barrier, as explained later. Located between the two central branches 28 of the W-shaped formwork are a number of reinforcing webs 31 of substantially trapezoidal shape and extending in planes perpendicular to the bearing walls 1 and 2. In line with each trapezoidal reinforcing web 31, two more triangular webs 32 are welded between each central branch 28 and the adjacent end branch 23 of the formwork 21. The webs 31 and 32 are embedded in the thermally insulating material 22 of the composite girder 20 and are located substantially mid-way between two wells 24.

With the walls 1 and 2, the formwork 21 defines a connecting ring in the corner of the tank.

In line with each arm of the anchor bracket 30, an indentation 33 is formed on the external surface of the insulating material 22 facing toward the inside of the tank. The top of wells 24 opens into this indentation 33. The adjacent element 4 of the secondary insulating barrier comprises a sheet 7 forming a cover which is interrupted in the vicinity of the composite girder 20 so as to leave an empty space opposite the indentation 33 of the composite girder 20. Thus, a plywood sheet 34 which covers the joint may be fitted so that it straddles the composite girder 20 and the adjacent element 4, resting respectively on the indentation 33 and the empty space of the adjacent element 4. The sheet 34 covers the space between the composite girder 20 and the adjacent element 4, this intermediate space being filled with flexible thermally insulating material 10 as explained earlier.

Connection between the primary and secondary watertightness barriers and the composite girder 20 is by means of special strakes hereafter known as liner plates.

Figure 8:
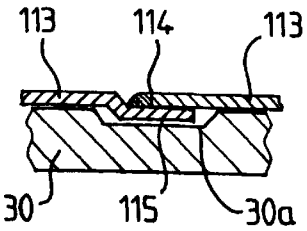
FIG. 8 is a partial, enlarged view in section on the line VIII—VIII of FIG. 7, showing the zone of connection between two adjacent liner plates above the composite girder anchor bracket.
Figure 9:
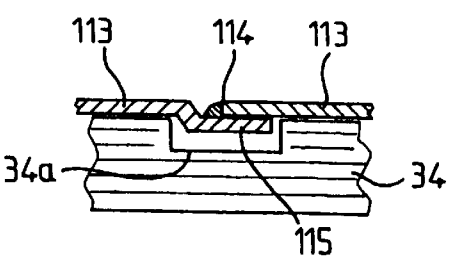
FIG. 9 is a partial enlarged view in section on the line IX—IX of FIG. 7, showing the zone of connection of two adjacent liner plates above a sheet of plywood which serves to cover the join between the composite girder and an adjacent element of the secondary insulating barrier.
Figure 6:
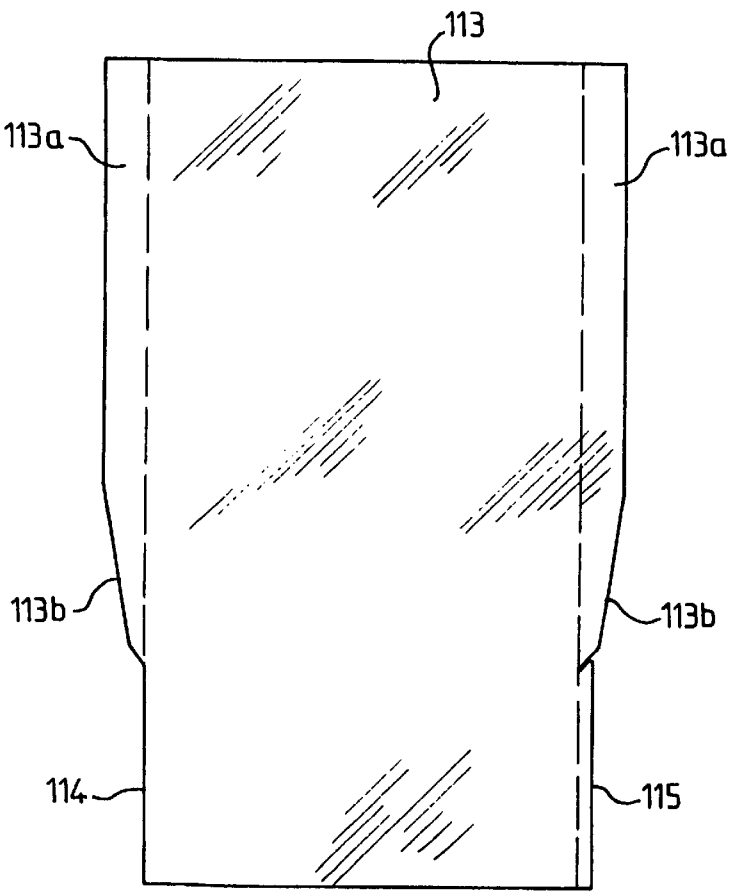
FIG. 6 is a view from above of a secondary watertightness liner plate in its unfolded state, for connecting the secondary watertightness barrier to the composite girder, as illustrated in FIG. 1.
Figure 11:
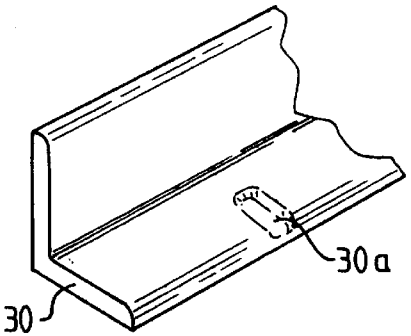
FIG. 11 is a partial perspective view of the anchor bracket illustrated in FIG. 8.
Figure 10:
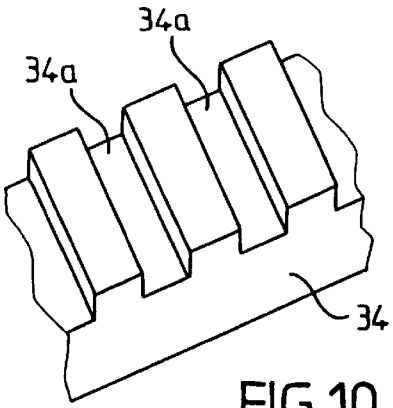
FIG. 10 is a partial perspective view of the sheet illustrated in FIG. 9.

As can be seen in FIGS. 6 to 11, the secondary watertightness liner plates 113 can be distinguished from the strakes 13 of the secondary watertightness barrier by the fact that the turned-up edges 113*a* extend over only part of the length of the liner plates 113, each turned-up edge 113*a* tapering gradually in the manner of a whistle near the composite girder. The inclined edges 113*b* of the turned-up edges 113*a* end a certain distance from the proximal edge of the liner plate 113. In line with one of the turned-up edges 113*a*, the liner plate 113 comprises, on its proximal portion, a straight edge 114 and, in line with the other turned-up edge 113*a*, an overlapping lug 115 which is bent slightly downward to be overlapped by the straight edge 114 of the adjacent liner plate, in the manner of a set of tiles. A continuous weld is made between the straight edge 114 of one liner plate 113 and the underlying overlapping lug 115 of an adjacent liner plate 113, to ensure the continuity of the watertightness at the secondary watertightness barrier, as visible in FIGS. 8 and 9. The overlapping lugs 115 of the secondary watertightness liner plates 113 extend partially along the aforementioned sheet 34 covering the joint and over one arm of the anchor bracket 30. The sheet 34 on its upper face has square-sided cutouts 34*a* running parallel to the turned-up edges 113*a* to accommodate the overlapping lugs 115, as illustrated in FIGS. 9 and 10. In line with some of the squaresided cut-outs 34*a* in the sheet 34, cavities 30*a* are machined in situ in the arms of the anchor bracket 30, also to house the overlapping lugs 115, as can be seen in FIGS. 8 and 11.

The overlapping lugs 115 provide support for the run of welding with the straight edge 114 of the adjacent liner plate.

The proximal portion of the secondary watertightness liner plates 113 is welded discontinuously to one arm of the anchor bracket 30 to provide mechanical fastening while at the same time allowing transverse expansion of the said secondary watertightness liner plate and of the anchor bracket.

Continuity of the watertight connection of the secondary watertightness barrier at the corner connection is provided by a secondary watertightness bracket 35, for example made of Invar in the shape of a right angle bracket, the two arms of which respectively overlap the proximal portion of the secondary watertightness liner plates on each side of the solid angle 3 of intersection, the said secondary watertightness bracket 35 being continuously welded to the said secondary watertightness liner plates in order to provide watertightness. Thus the secondary watertightness barrier's functions of watertightness and of anchorage on the composite girder, have been separated.

By way of a numerical example, the W-shaped formwork 21 of the composite girder 20 is about 8 mm thick, the anchor bracket 30 is about 6 mm thick, and each arm of the said bracket is about 60 mm wide. The unit length of a composite girder is about 1 m, with a spacing of 200 mm between each well, the end wells being about 100 mm from the edge of the girder. The reinforcing webs together define an oblique strip perpendicular to the plane bisecting the corner of the tank, the webs being about 8 mm thick, with a total length in the oblique direction of about 80 mm. In the case of a girder about 1 m long, the number of wells is advantageously 5, these wells being intended to take studs 18 mm in diameter. The sheet 34 is 12 mm thick as is the sheet 7 forming the cover of the secondary insulating barrier elements and the square-sided cutouts 34*a* in the sheet 34 are made every 10 mm with a width of 10 mm and a depth of 3 mm, while the machinings 30*a* in the anchor bracket 30 are made about every 500 mm with a width of about 10 mm and a depth of 2 to 3 mm. The overlapping lugs 115 of the secondary watertightness liner plates may be 100 mm long, 10 mm wide and 1.5 mm thick in the case of a secondary watertightness liner plate 400 mm long and 540 mm wide in its unfolded state.

As the square-sided cut-outs 34*a* are formed at uniform intervals of 10 mm, only those cut-outs which are located every 500 mm at the interface between two secondary liner plates 113 will contain overlapping lugs 115 belonging to the secondary watertightness liner plates 113.

Figure 12:
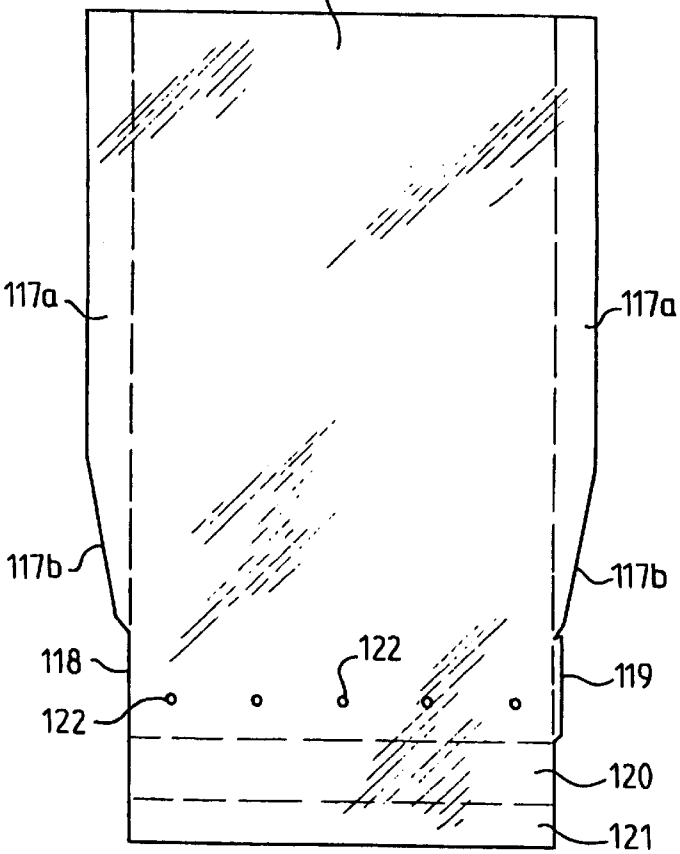
FIG. 12 is a view from above of a primary watertightness liner plate in its unfolded state, for connecting the primary watertightness barrier and the composite girder, as illustrated in FIG. 1.
Figure 14:
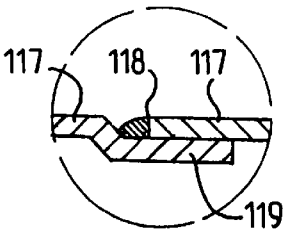
FIG. 14 is a partial enlarged view in section on the line XIV—XIV of FIG. 13.
Figure 13:
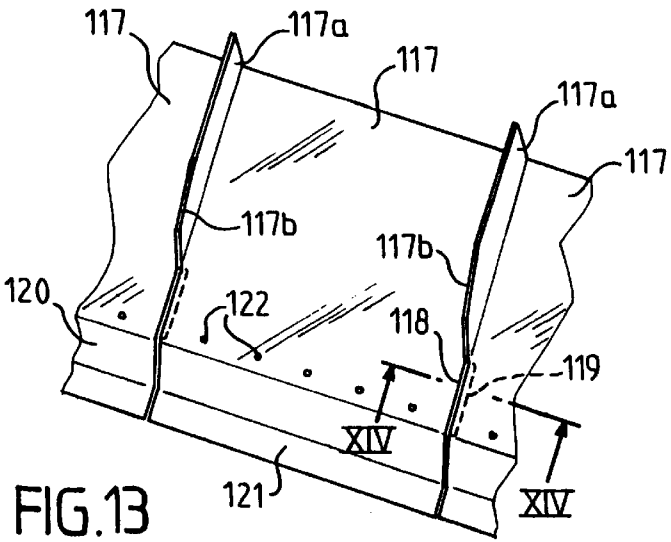
FIG. 13 is a partial perspective view of the liner plates of FIG. 12 in their assembled state.

Referring now to FIGS. 12 to 14, a description will be given of the primary watertightness liner plates 117, which can be distinguished from the strakes 17 of the primary watertightness barrier by the fact that the turned-up edges 117*a* taper gradually near the composite girder. The edges 117*b* which are inclined substantially in the manner of a whistle, of the turned-up edges 117*a* end some distance from the proximal edge of the primary watertightness liner plate 117. One of the turned-up edges 117*a* is extended by a straight edge 118, whereas the other turned-up edge 117*a* is extended by an overlapping lug 119 about 50 mm long and 10 mm wide with a thickness of 1.5 mm. By way of comparison, the turned-up edges are 20 mm tall. The overlapping lugs 119, unlike the overlapping lugs 115 of the secondary watertightness liner plate 113, extend partially in the direction of the composite girder and are defined only in the plane of the primary watertightness barrier. The end part, which lies beyond the overlapping lug 119, of the primary watertightness liner plate 117, has straight lateral edges, and this end part is bent substantially in the manner of the steps of a staircase, with a height that corresponds to the thickness of the panel 16 of the mechanical protection shield. The staircase-shaped part comprises a portion 120 inclined substantially in the direction of the solid angle 3 of intersection and ends in a lug 121 which is welded discontinuously to the proximal portion of the secondary watertightness liner plate 113, as illustrated in FIG. 1. The discontinuous welding of the lug 121 to the primary liner plate 113 provides mechanical attachment. A number of holes 122 are made through the primary liner plate 117 in a transverse row with respect to the overlapping lug 119. These holes 122, of which there are 5 for example, are intended to take fixing screws 123 for fixing the proximal portion of the primary liner plate to the top side of a panel 16 of the mechanical protection shield. The panel 16 which supports the primary watertightness liner plate 117 has an inclined face 16*b* corresponding to the inclined portion 120 of the liner plate 117.

In the case of the overlapping lugs 119 of the primary watertightness liner plates 117, it is not necessary to provide recesses in the panels 16 of the shield, because these overlapping lugs 119 are located at the interface between two panels 16.

As visible in FIG. 4, the panels 16 of the shield are not as wide as the primary and secondary watertightness strakes, which means that the overlapping lugs 119 can be accommodated in the intermediate space between two adjacent panels of the shield.

A primary watertightness bracket 36 made of Invar and substantially in the shape of a right angle bracket provides continuity of the watertight connection of the primary watertightness barrier at the corner of the tank. The two arms of the primary watertightness bracket 36 extend respectively in the plane of the primary watertightness barrier on each side of the solid angle 3 of intersection and cover the holes 122 in the primary watertightness liner plate 117, which holes might otherwise constitute a rift in the watertightness of the primary watertightness barrier. The arms of the primary watertightness bracket 36 are welded continuously to the primary liner plates 117 beyond the holes 122. The size of this primary watertightness bracket 36 is greater than that of the secondary watertightness bracket 35, as can be seen in FIG. 1. Thus, the primary watertightness barrier's functions of watertightness and of anchorage to the composite girder have been separated.

Two parallelepipedal blocks 37 with inclined edges are inserted in the space between the two watertightness brackets 35 and 36 and the inclined portions 120 of the primary liner plates 117, the blocks 37 being made of plywood to ensure the continuity of the protective shield.

An alternative form of the secondary insulating barrier will now be described with reference to FIGS. 15 to 19.

Each element 104 of the secondary insulating barrier consists, like the aforementioned elements 4, of a bottom sheet 5 made of plywood 9 mm thick, of a sheet 7 of plywood forming a cover 12 mm thick and of an intermediate layer of insulating material 106 which here consists of a block with a cellular honeycomb structure. The total thickness of an element 104 is, for example, about 270 mm, its width is 1 m and its length is 3 m.

The block 106 with a honeycomb structure is preferably made by folding a cardboard blank and the cells are set out in a 20 mm-by-20 mm hexagonal mesh.

The lateral faces of the cells of the block 106 are perforated with holes 107 about 3 mm in diameter, the holes 107 being perforated every 30 mm in the direction of the thickness of the block 106.

The holes 107 in the block 106 make it possible to create a vacuum in the volume occupied by the secondary insulating barrier, for example by pumping air from this volume until it is at a reduced pressure of the order of 2 millibar. The holes 107 thus allow air to be drawn out of the elements 104.

Along each longitudinal edge of an element 104 there are several wells 108, for example four wells, extending through the sheet 7 forming the cover and the thickness of the block 106, the bottom sheet 5 forming the bottom of the wells 108. A hole 109 is made through the bottom sheet 5, in line with each well 108, for the passage of a threaded stud, as was described earlier with reference to the elements 4.

Before it is bent into a cellular honeycomb structure, the cardboard blank used to produce the block 106 may be covered with silver leaf or polished aluminum or any other radiation-reflecting element, to reduce the thermal losses by radiation.

Figure 16:
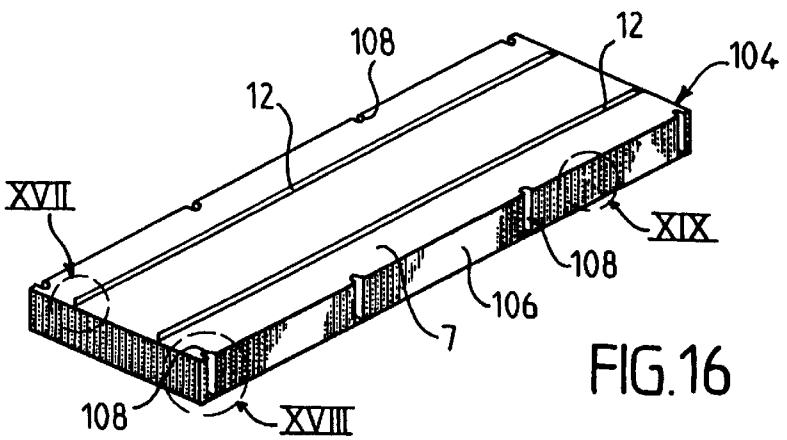
FIG. 16 is a perspective view of the element of FIG. 15 in its assembled state.
Figure 18:
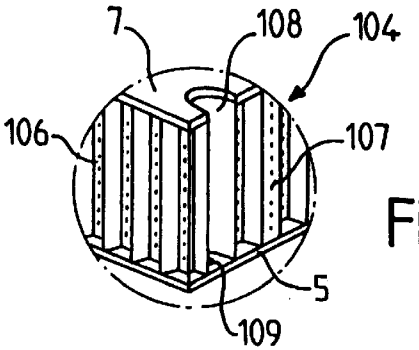
FIGS. 17 to 19 are enlarged views of a detail ringed in FIG. 16 in the direction of arrows XVII, XVIII and XIX, respectively.
Figure 19:
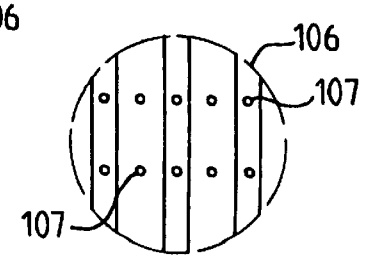
Figure 17:
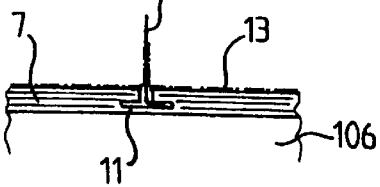
Figure 15:
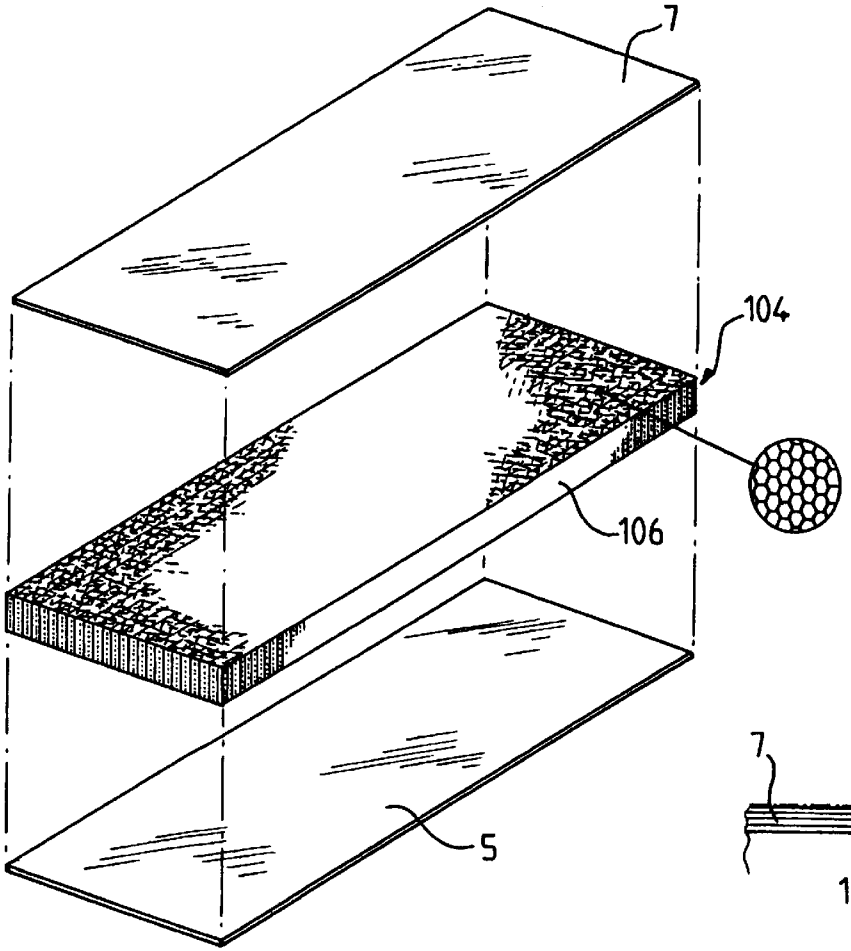
FIG. 15 is an exploded perspective view of one element of the secondary, insulating barrier according to the third subject of the invention.

As can be seen in FIG. 16, the upper face of the sheet 7 forming the cover has two longitudinal slots spaced apart by about 500 mm and arranged symmetrically with respect to the center of the sheet, to accommodate two weld flanges 12 between which a strake 13 or a secondary watertightness liner plate 113 of the secondary watertightness barrier is arranged. As an element 104 is about 1 m wide, a 500-mm strake 13 may be fitted astride two adjacent elements 104, welding it by its turned-up edges 13*a* to a weld flange 12 of each element 104.

In FIG. 1, it can be seen that the composite girder 20 comprises an oblique side 39 extending at right angles to the plane bisecting the corner of the tank, to define a drainage space 40, of substantially triangular cross section, near the solid angle 3 of intersection.

As the primary and secondary watertightness barriers are not thermally insulated from one another, because the shield between them merely provides protection against impact only, there is no risk that the primary watertightness liner plates 117 will become unfolded at their inclined portion 120, because there is practically no differential contraction between the two watertightness barriers.

Because of the presence of the impact-absorbing shield, when the tank is not completely full, for example when it is less than 80% full, there is no risk that waves lashing about in the tank will damage the watertightness of the tank.

Although the invention has been described in conjunction with a number of particular embodiments, it is quite obvious that it is not in any way restricted thereto and that it comprises all technical equivalents of the means described and their combinations if these fall within the scope of the invention.

What is claimed is:

1. Watertight and thermally insulating tank built into the bearing structure (1, 2) of a ship, the tank comprising two successive watertightness barriers, one of them a primary one (17) in contact with the product contained in the tank, and the other a secondary one (13) located between the primary watertightness barrier and the bearing structure, thermal insulation consisting of a thermally insulating barrier only located between the secondary watertightness barrier and the walls of the bearing structure and substantially no thermal insulation between the primary and secondary watertightness barriers, said tank comprising an impact-resistant mechanical protecting shield (16) located between the two watertightness barriers (13, 17), the shield (16) being held elastically pressed against the secondary watertightness barrier (13) by metal fastening means (12) mechanically connected to the insulating barrier (4, 104).

2. Tank according to claim 1, characterized in that the secondary watertightness barrier is made up of metal strakes (13) with edges **(13*a*) turned up toward the inside of the tank, the said strakes being made from thin plate with a low coefficient of expansion and being butt-welded, via their turned-up edges, onto the two faces of a weld support (12*b*) which is held mechanically on the elements (4, 104) of the insulating barrier by an expansion joint, the said weld support constituting part of the fastening means (12) intended to mechanically hold the shield (16) on the secondary watertightness barrier (13)**.

3. Tank according to claim 2, characterized in that the shield consists of a number of substantially parallelepipedal rigid plywood panels (16) of small thickness, for example of the order of 21 mm thick, between which the aforementioned fastening means (12) pass.

4. Tank according to claim 3, characterized in that the weld support **(12*b*) comprises a transverse row of lugs (15) partially cut out from its thickness and alternately bent to one side of its plane and then to the other, into housings (16*a*) made in the upper part of the periphery of the panels of the shield (16), to temporarily hold the shield on the secondary watertightness barrier (13) before the primary watertightness barrier (17)** is fitted.

5. Tank according to claim 4, characterized in that the insulating barrier comprises a number of substantially parallelepipedal elements each consisting of a layer of insulating material sandwiched between two sheets of plywood which respectively form the bottom and the cover of one element of the insulating barrier, the said sheets being bonded on their inside face to the said layer and serving via their external surface, to provide the connection with the bearing structure and with the secondary watertightness harrier, respectively.

6. Tank according to claim 3, characterized in that the insulating barrier comprises a number of substantially parallelepipedal elements each consisting of a layer of insulating material sandwiched between two sheets of plywood which respectively form the bottom and the cover of one element of the insulating barrier, the said sheets being bonded on their inside face to the said layer and serving via their external surface, to provide the connection with the bearing structure and with the secondary watertightness barrier, respectively.

7. Tank according to claim 2, characterized in that the insulating barrier comprises a number of substantially parallelepipedal elements each consisting of a layer of insulating material sandwiched between two sheets of plywood which respectively form the bottom and the cover of one element of the insulating barrier, the said sheets being bonded on their inside face to the said layer and serving via their external surface, to provide the connection with the bearing structure and with the secondary watertightness barrier, respectively.

8. Tank according to claim 7 taken in combination, characterized in that the fastening means (12) are L-profile strips each having a short side **(12*a*) and a long side (12*b*) forming a right angle bracket, the long side forming the weld support (12*b*) and the short side being inserted in an inverted T-shaped slot (11) made in the thickness of a rigid cover-forming sheet (7) of the elements (4, 104) of the insulating barrier and supporting the secondary watertightness barrier (13), the free end of the weld support (12*b*) projecting toward the inside of the tank with respect to the primary watertightness barrier (17)**.

9. Tank according to claim 8, characterized in that the primary watertightness barrier is made up of metal strakes (17) with edges **(17*a*) turned up toward the inside of the tank, the said strakes being made from thin plate with a low coefficient of expansion and being butt-welded, via their turned-up edges, onto the two faces of the said weld support (12*b*) which is held directly by the insulating barrier (4, 104)**.

10. Tank according to claim 9, in that the sheet (7) which forms the cover comprises two parallel slots (11) each accommodating a weld support **(12*b*) and which are spaced apart by a distance that corresponds to the width of a strake (13), the central zones of the sheets forming covers of two adjacent elements (4, 104)** each being covered by a strake, while another strake of the same width joins the aforementioned two strakes together.

11. Tank according to claim 9, characterized in that the layer of insulating material is a polyurethane foam with a density of between 90 and 120 kg/m$^3$, preferably of the order of 100 kg/m$^3$.

12. Tank according to claim 8, characterized in that the layer of insulating material is a polyurethane foam with a density of between 90 and 120 kg/m$^3$, preferably of the order of 100 kg/m$^3$.

13. Tank according to claim 8, characterized in that the layer of insulating material is a block with a cellular honeycomb structure giving high mechanical strength.

14. Tank according to claim 1, characterized in that the insulating barrier comprises a number of substantially parallelepipedal elements (4, 104) each consisting of a layer of insulating material (6, 106) sandwiched between two sheets of plywood which respectively form the bottom (5) and the cover (7) of one element of the insulating barrier, the said sheets being bonded on their inside face to the said layer and serving via their external surface, to provide the connection with the bearing structure (1, 2) and with the secondary watertightness barrier (13), respectively.

15. Tank according to claim 14, characterized in that the layer of insulating material (6) is a polyurethane foam with a density of between 90 and 120 kg/m$^3$, preferably of the order of 100 kg/m$^3$.

16. Tank according to claim 14, characterized in that the layer of insulating material is a block (106) with a cellular honeycomb structure giving high mechanical strength.

17. Tank according to claim 16, characterized in that the block (106) with honeycomb structure comprises radiation-reflecting elements covering at least part of the flat internal faces of the cells of the honeycomb structure, it being possible for these radiation-reflecting elements to consist of silver leaf or polished aluminum.

18. Tank according to claim 16, characterized in that at least some of the walls of the cells of the honeycomb block (106) are perforated so as to allow fluid communication between the said cells and the outside of the block, and the volume occupied by the insulating barrier (104) is subject to a reduced pressure of between 0.1 and 300 millibar absolute, preferably between 2 and 3 millibar.

19. Tank according to claim 16, characterized in that the block (106) with a cellular honeycomb structure is obtained from a folded cardboard blank.

20. Tank according to claim 16, characterized in that it comprises means of fixing the insulating barrier (104) to the bearing structure (1, 2), these fixing means comprising studs welded substantially at right angles to the internal walls of the bearing structure, the said studs each having a threaded free end, the relative arrangement of the studs and of the elements of the insulating barrier being contrived to be such that the studs are in register with two opposed peripheral edges of the bottom sheet (5) of the elements of the insulating barrier, a well (108) being formed through the cover-forming sheet (7) of the said element and through the thickness of the honeycomb block (106) in register with each stud, the bottom of the well consisting of the bottom sheet which has a hole (109) for the passage of a stud, a washer placed over the stud pressing against the bottom of the well and being held in place by a nut screwed onto the stud so as to fix the said element of the secondary insulating barrier to the bearing structure.

* * * * *